United States Patent [19]

Crick et al.

[11] Patent Number: 5,072,562

[45] Date of Patent: Dec. 17, 1991

[54] DECORATIVE WALL COVERING

[75] Inventors: Dallas M. Crick, Pembroke Pines, Fla.; James G. Perkins, Wilmette, Ill.; Douglas F. Hudson, Jr., Miami, Fla.

[73] Assignee: Nailite International, Miami, Fla.

[21] Appl. No.: 487,910

[22] Filed: Mar. 5, 1990

[51] Int. Cl.[5] ..... E04O 1/26

[52] U.S. Cl. ..... 52/533; 52/521; 52/553; 52/555

[58] Field of Search ..... 52/533, 543, 546, 520, 52/521, 553, 555

[56] References Cited

U.S. PATENT DOCUMENTS

| | | | |
|---|---|---|---|
| 3,160,245 | 5/1960 | Pavlecka . | |
| 3,217,453 | 11/1965 | Medow . | |
| 3,233,382 | 2/1966 | Graveley . | |
| 3,296,759 | 1/1967 | Pavlecka . | |
| 3,304,667 | 2/1967 | Donegan . | |
| 3,363,380 | 1/1968 | Merrill . | |
| 3,485,002 | 12/1969 | Baker . | |
| 3,605,369 | 9/1971 | Merrill et al. . | |
| 3,613,326 | 10/1971 | Mollman . | |
| 3,667,184 | 6/1972 | Merrill et al. . | |
| 3,686,813 | 8/1972 | Breitweiser et al. . | |
| 3,754,366 | 8/1973 | Jansson et al. . | |
| 3,837,133 | 9/1974 | Mollman . | |
| 3,899,855 | 8/1975 | Gadsby . | |
| 4,015,391 | 4/1977 | Epstein et al. . | |
| 4,107,885 | 8/1979 | Lindal . | |
| 4,251,967 | 2/1981 | Hoofe, III . | |
| 4,343,126 | 8/1982 | Hoofe, III . | |
| 4,423,572 | 1/1984 | Tor . | |
| 4,435,938 | 3/1984 | Rutkowski et al. | 52/521 |
| 4,459,788 | 7/1984 | Bockwinkel . | |
| 4,476,661 | 10/1984 | Hoofe, III . | |
| 4,522,002 | 6/1985 | Davis et al. . | |
| 4,586,304 | 5/1986 | Flamand . | |
| 4,598,522 | 7/1986 | Hoofe, III . | |
| 4,680,911 | 7/1987 | Davis et al. . | |

*Primary Examiner*—Michael Safavi

*Attorney, Agent, or Firm*—Leydig, Voit & Mayer

[57] ABSTRACT

A wall covering comprising a plurality of plastic molded panels each having a relatively thin body portion formed with rows of simulated of shake shingles. The panels are mounted on a support surface, such as a wall or roof, in a plurality of vertically spaced horizontal courses with a lower marginal edge region of the panels in one course overlapping the upper marginal edge regions of the panels in the course immediately below and with side marginal edge regions of adjacent panels also overlapping. The overlapping marginal edge regions each are formed with a plurality of parallel water barrier ridges for impeding movement of water outwardly over the peripheral edges of the underlying marginal edge region, as well as into nail mounting holes. The water barrier ridges are discontinous so as to impede outward water movement, while allowing drainage of water in a downward direction. The wall covering panels further have various interlocking features which maintain sealing contact between overlapping upper and lower marginal edge regions and which facilitate alignment and mounting of the panels on the support surface.

47 Claims, 4 Drawing Sheets

DECORATIVE WALL COVERING

The present invention relates generally to roof and wall coverings primarily intended for outdoor usage, and more particularly, to roof and wall coverings comprised of relatively large panels which each are molded or otherwise formed with decorative patterns characteristic of conventional roofing and siding materials such as shake, tile, brick or the like.

Various synthetic roof and wall coverings are known today, such as those formed of elongated thermoplastic panels that are nailed to the wall or roof support surface in horizontal courses or rows in partially overlapping relation to each other so as to provide a substantially water resistant, protective layer over the support surface. While it is desirable that the panels facilitate drainage of rain water and the like to which they are exposed in the outside environment, heretofore this has presented problems. Because of the surface tension of water, capillary action often causes water to be drawn inwardly between overlapping marginal edge portions of adjacent panels and enter the space beneath the panels, either through nail holes or about the peripheral edges of the panels and to become trapped and accumulate under the panels. Such capillary water movement worsens during high wind and storm conditions. Not only does the trapped moisture under the panels increase the possibility for leakage and damage to the wall or roof, but upon freezing, the expanding moisture tends to lift the overlapping edge portions further breaking the protective barrier between the panels and the support surface. When efforts have been made to prevent such capillary seepage between panels, they often have been ineffective, or have complicated the construction and cost of the panel, or have impeded the natural drainage of water from the panels.

It is an object of the present invention to provide a wall and roof covering made of synthetic panels which is adapted to form a substantially water resistant barrier over the support surface, even during relatively extreme adverse weather conditions.

Another object is to provide a wall and roof panel as characterized above which includes means for impeding and preventing capillary movement of water between overlying marginal edge portions of adjacent panels.

A further object is to provide a wall and roof panel of the foregoing type which prevents capillary movement of water between overlapping portions of the panel while permitting free drainage of water that may enter the space between overlapping panel portions.

Still another object is to provide a wall and roof panel of the above kind which is of relatively simple construction so as to lend itself to economical manufacture and easy fail proof installation.

Other objects and advantages of the invention will become apparent upon reading the following detailed description and upon reference to the drawings, in which:

FIG. 1 a perspective of a pair of panels that form the wall covering of the present invention, with one panel shown in exploded or separated relation to the other;

Figure 1:
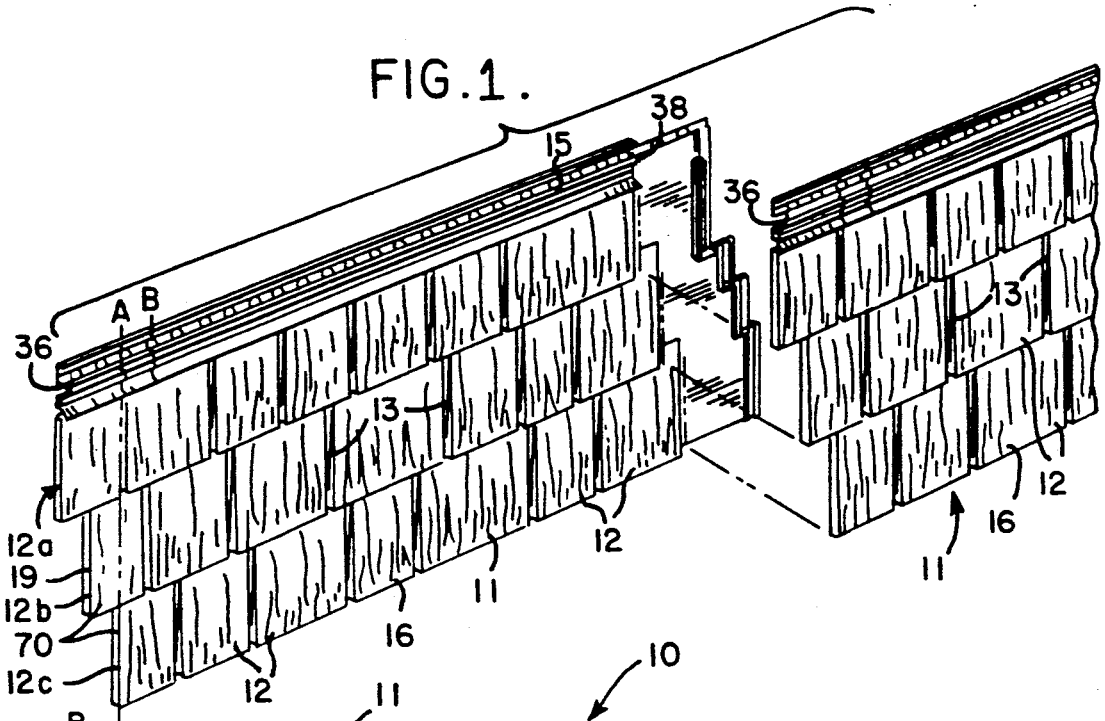

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling with the spirit and scope of the invention.

Referring now more particularly to the drawings, there is shown an illustrative wall covering 10 comprising a plurality of panels 11 each embodying the present invention. The panels 11 , which preferably are molded out of relatively thin rigid plastic material, each are formed with simulated building elements. In this instance, the panels 11 are formed with simulated shake 12 of irregular width which are disposed in a plurality of parallel rows of 12*a*, 12*b* and 12*c*. The illustrated simulated shake pattern is of a type known in the industry as "perfection" shake, wherein the lower edges 14*a*, 14*b*, 14*c* of each row 12*a*, 12*b*, 12*c* are in a substantially straight line. It will be understood that the panels 11 could be formed with other forms of simulated cedar shake shingles, or other types of building materials, such as tile, brick and the like.

Each panel 11 has an upper horizontal marginal edge region 15 having a substantially uniform width w extending across the top of the panel immediately above the top row 12*a* of shake 12 (FIG. 3), a lower marginal edge region 16 which defines a lower peripheral edge of the panel, a side marginal edge region 18 of non-uniform but generally similar width as the upper marginal edge region 15, and in this instance, located to the right-hand side of the last simulated shake 12 in each row 12*a*, 12*b*, and 12*c*, a marginal edge region 19 on the opposite side of the panel 11 which defines a left-side peripheral edge immediately adjacent the first simulated shake of each row 12*a*, 12*b*, 12*c*. The panels 11 are mounted on a support surface 25, which may be a wall or roof of a house or other building structure, in horizontal courses with the right-side marginal edge region 18 in underlying relation to the left-side marginal edge region 19 of the panel immediately to the right thereof and with the lower marginal edge region 16 of the panels in each course overlying the upper marginal edge region 15 of the panels in the course immediately below.

The panels 11 preferably are mounted beginning with the left-hand panel of the lowermost course to be installed on the wall or roof, as is known in the art. The first panel in each course typically is cut at a different location along a left-hand side thereof in order that the simulated shake 12 of each course are offset with respect to the simulated shake of the panel in the course below so as to enhance the natural appearance of the wall covering. The panels 11 in this instance each have two predetermined cutting lines A, B along which the panels alternatively may be cut to start alternate courses as disclosed in applicants' simultaneously filed application Ser. No. 07/488,351, the disclosure of which is incorporated herein by reference. Following such mounting procedure, simulated shake 12 in the lowermost row 12*c* of each panel are automatically offset from the shake in the uppermost row 12*a* of the panel immediately therebelow.

Figure 7:
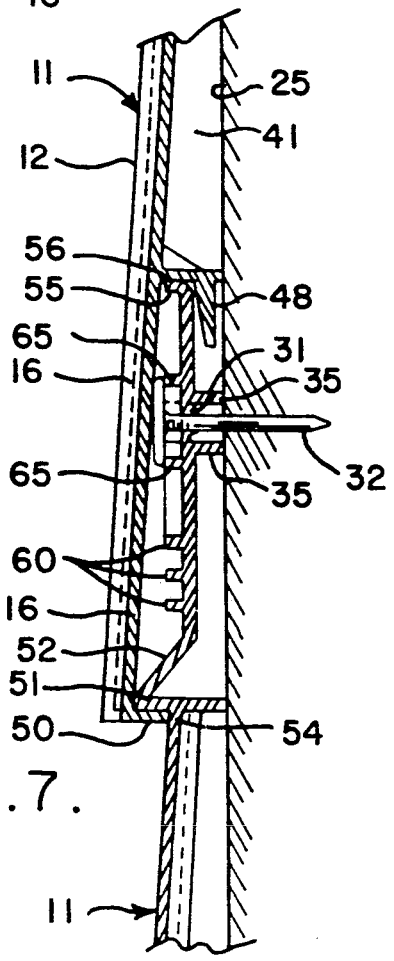
FIG. 7 is an enlarged fragmentary section showing the overlapping lower and upper marginal edge regions of panels of the illustrated wall covering.
Figure 9:
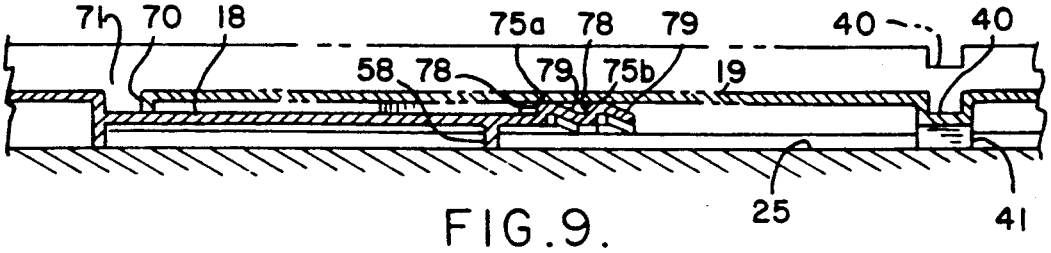
FIG. 9 is an enlarged fragmentary section of the right marginal edge region of the illustrated panel taken in the plane of line 9—9 in FIG. 8 and showing the left marginal edge region of an adjacent panel in mounted relation thereto.

For securing the panels 11 to the support surface 25, the upper marginal edge region 15 of each panel is formed with a plurality of elongated laterally spaced nailing apertures 30. To enhance the water barrier features of the wall covering 10, as will become apparent, the nailing apertures 30 preferably are covered with a thin plastic flashing 31 during the molding process (FIGS. 7 and 9). Upon nailing each panel 11 to the support surface 25, the nail 32 will pierce the flashing 31, with the flashing 31 maintaining a relatively tight seal about the nail. Since the flashing 31 is relatively thin, such as on the order of 0.010 inch, it will allow horizontal expansion and retraction of the panel 11 as occurs during normal temperature variations in the outdoor environment.

Figure 5:
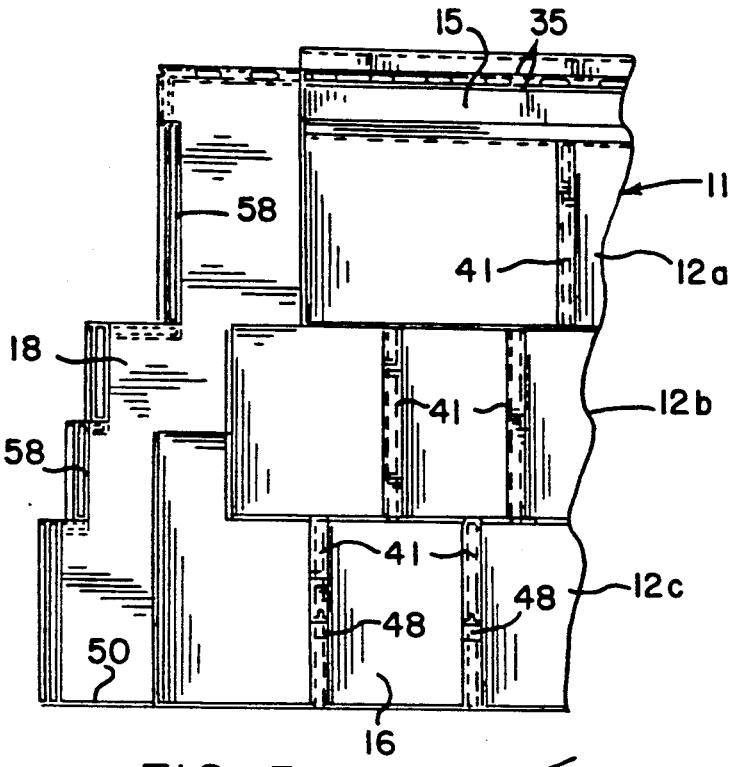
FIG. 5 is an enlarged rear-side plan view of a right-hand portion of the panel shown in FIG. 3.
Figure 6:
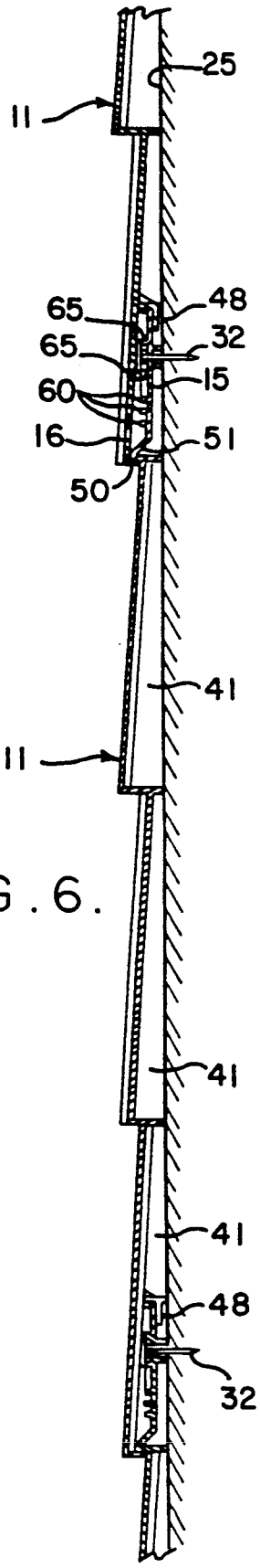
FIG. 6 is an enlarged fragmentary section of the illustrated wall covering, taken in the plane of line 6—6 in FIG. 2.

For providing firm support for the mounted panels on the wall and roof upon nailing and for establishing a seal between the rear side of the panel 11 and the support surface 25, the upper marginal edge region 15 is formed with a pair of rearwardly extending horizontal sealing flanges 35 which extend substantially the length of the upper marginal edge region 15 and which are disposed on opposite sides of the nailing apertures 30 (FIGS. 5 and 7). Once the upper marginal edge region 15 is nailed to the support surface, the horizontal sealing flanges 35 are maintained firmly against the support surface 25 and cannot be lifted from the support surface even during severe weather conditions.

Figure 3:
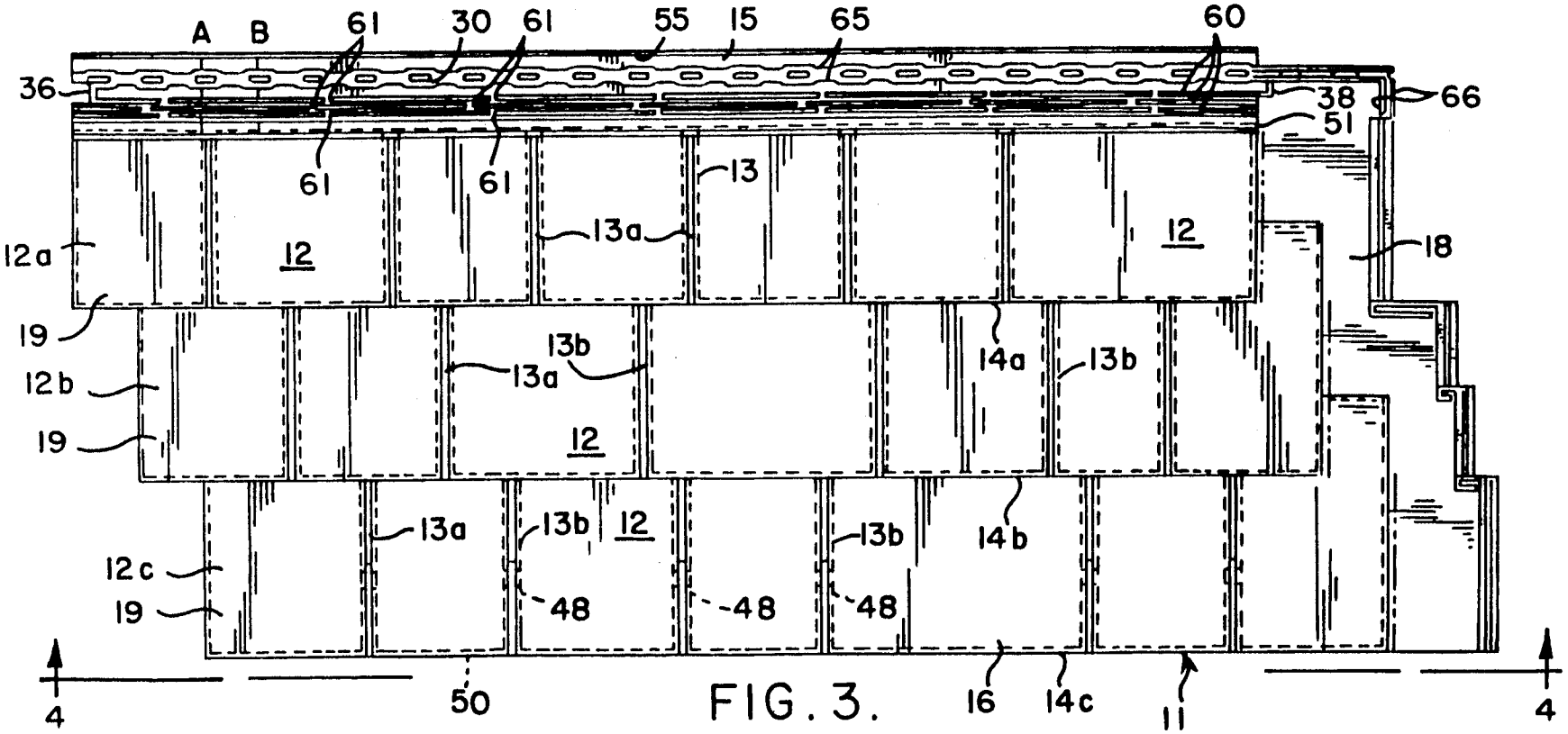
FIG. 3 is a plan view of the face-side of one of the panels of the illustrated wall covering.

To facilitate horizontal alignment of the panels 11 during mounting of each course, the upper marginal edge region 15 of each panel is formed with an outwardly opening, generally rectangular configured locating slot 36 on the left-hand side thereof which is positionable onto a raised, generally rectangular locating lug 38 formed on the top right-hand side of the upper marginal edge region 15 of the previously mounted panel (FIGS. 3 and 9). The left-side marginal edge region 19 preferably is positionable onto the right-side marginal edge region 18 of the adjacent panel such that an expansion space or gap, on the order ¼ inch, remains between the end of the locating lug 38 and the end of the locating slot 36.

To further provide for stable mounting of each panel 11 on the support surface 25, gaps or grooves 40 formed between each simulated shake 12 on the face of the panel 11 define rigidifying and support ridges 41 on the underside of the panel for positioning directly onto the support surface 25. While each simulated shake 12 has a downwardly and outwardly tapered outer face to simulate the appearance found in natural shake, the supporting ridges 41 each have a rear face adapted for flush mounting against the support surface 25.

In order to facilitate mounting o the panels 11 in side-by-side relation with the junctures between adjacent panels less noticeable to the eye, the rows 12*a*, 12*b*, 12*c* of shake 12 of each panel 11 extend in offset relation to each other so as to define stepped left and right-hand sides of the panel. In the illustrated embodiment, the middle row 12*b* of shake extends farther to the right than the first row 12*a* a distance corresponding to about one-quarter to one-half the width of one shake 12, and the bottom row 12*c* extends farther to the right than the middle row 12*b* about a similar distance. Hence, the right and left-side marginal edge regions 18, 19 of the panels similarly are stepped.

For positively interlocking the lower marginal edge region 16 of each panel to the upper marginal edge region 15 of the panel nailed to the support surface 25 immediately below, the underside of each panel has a plurality of integrally formed, laterally spaced, downwardly directed hooks 48 adapted for engaging the upper peripheral edges of the panels in the course below. The hooks 48 in this instance are formed at the lower ends of rigidifying ridges 41 located rearwardly of the lowermost row 12*c* of simulated shake. To permit overlapping by the lower marginal edge region 16, the support ridges 41 for the lowermost row of shake 12*c* terminate in upwardly spaced relation to the lower peripheral edge of the panel 11.

For properly positioning the lower marginal edge region 16 of one panel in overlapping relation to the upper marginal edge region 15 of the panel immediately therebelow, the bottom peripheral edge of each panel is in the form of a downwardly turned lip 50 that is positionable against an upwardly directed locating ledge 51 formed on the face side of the upper marginal edge region 15 of the underlying panel adjacent the upper edges of the top row 12*a* of simulated shake 12. Upon mounting of the panel 11, as shown in FIG. 7, the lower peripheral edge of the lower row 14*c* of simulated shake 12 is disposed above the upper peripheral edge of the top row 12*a* of simulated shake of the panel immediately therebelow, again simulating the appearance of overlapping natural shake. To prevent the downwardly turned peripheral lip 50 of the upper panel from catching on the locating ledge 51 of the lower panel during mounting, the upper side of the locating ledge 51 is in the form of an inclined ramp 52 which will tend to guide the bottom peripheral lip 50 over the locating ledge 51 into proper position during installation.

Figure 10:
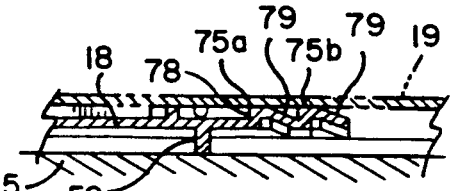
FIG. 10 is an enlarged fragmentary section, similar to FIG. 9, but taken in the plane of line 10—10 10 in FIG. 8.

For establishing seals between the overlapping bottom marginal edge region 16 of one panel and the upper marginal edge region 15 of the panel in the course immediately below, the downturned lower peripheral lip 50 bears against the face of the underlying panel to establish a primary seal 54 and the underlying panel has an upper peripheral edge in the form of an upwardly turned sealing lip 55 that is positionable into engagement with the underside of the lower marginal edge portion 16 of the overlapping panel to establish a secondary seal 56. The interlocking engagement of the upper marginal edge region 15 in the hooks 48 of the overlying panel retains the lips 50, 55 in sealing engagement to substantially prevent the entry of water into the space between the overlapping upper and lower marginal edge regions 15, 16. For providing firm support for the overlapping side marginal edge regions 15, 16, the right-hand marginal edge region 18 of each panel is formed with one or more depending support flanges 58 which are engageable with the support surface 25 (FIGS. 9 and 10).

In accordance with an important aspect of the invention, water barrier means are provided between the upper marginal edge region of each panel and the overlying lower marginal edge region of the panel in the course immediately above for impeding the upward capillary movement of water which may enter the space between the panels and thereby prevent seepage of such water through nail holes and over the upper peripheral edge of the underlying panel onto the wall or roof support surface. The water barrier means in this case comprises a plurality of horizontal barrier ridges 60 extending in upstanding relation from the face of the upper marginal edge region 15 of each panel 11. The barrier of ridges 60 are discontinuous in nature for impeding and slowing down the capillary movement of water upwardly between the overlapping upper and lower marginal edge regions 15, 16, while permitting effective drainage of the moisture in a downward direction in order to prevent moisture from being trapped between the panels, which might freeze and expand to interrupt and destroy the seals established between the marginal edge regions.

In the illustrated embodiment, three parallel barrier ridges 60 are integrally formed on the upper marginal region 15 of each panel between the locating ledge 51 and the nail apertures 30. The barrier ridges 60 each preferably are on the order of 1/16 to ⅛ inch in height and are disposed in vertically spaced relation to each other, with the lowermost barrier ridge 60 located in closely adjacent relation to the ramp 52 of the locating ledge 51. While the barrier ridges 60 extend substantially the length of the panel, they each are formed with a plurality of small drainage passages or openings 61 (FIG. 3). The drainage passages 61 for each barrier ridge are located in laterally offset relation to the drainage passages 61 of the adjacent ridge 60 so as to prevent a straight vertical path through the barrier ridges at any point which might permit unrestricted upward capillary movement of the water. The vertically spaced and laterally offset passages 61, however, enable gravity drainage of water downwardly in a circuitous path through the passages 61.

To further impede the capillary or creeping movement of water upwardly along the face of the upper marginal edge region 15 into the holes pierced by the mounting nails 32 and over the upper peripheral edge of the panel 11, a pair of uninterupted, upstanding nail aperture guard ridges 65 are integrally formed in the panel immediately adjacent top and bottom sides of the elongated nail apertures 30. The illustrated nail aperture guard ridges 65 extend the entire length of the upper marginal edge region 15. As a result, even water that may ultimately climb the multiplicity of barrier ridges 60 is impeded by the guard ridges 65 from entering the nail holes and reaching the upper peripheral edge of the panel. The nail aperture guard ridges 65 in this instance extend outwardly to the right-hand peripheral end of the panel 11 and communicate with a pair of laterally spaced vertical ridges 66 which facilitate downward drainage of moisture which may accummulate between the guard ridges 65.

Figure 8:
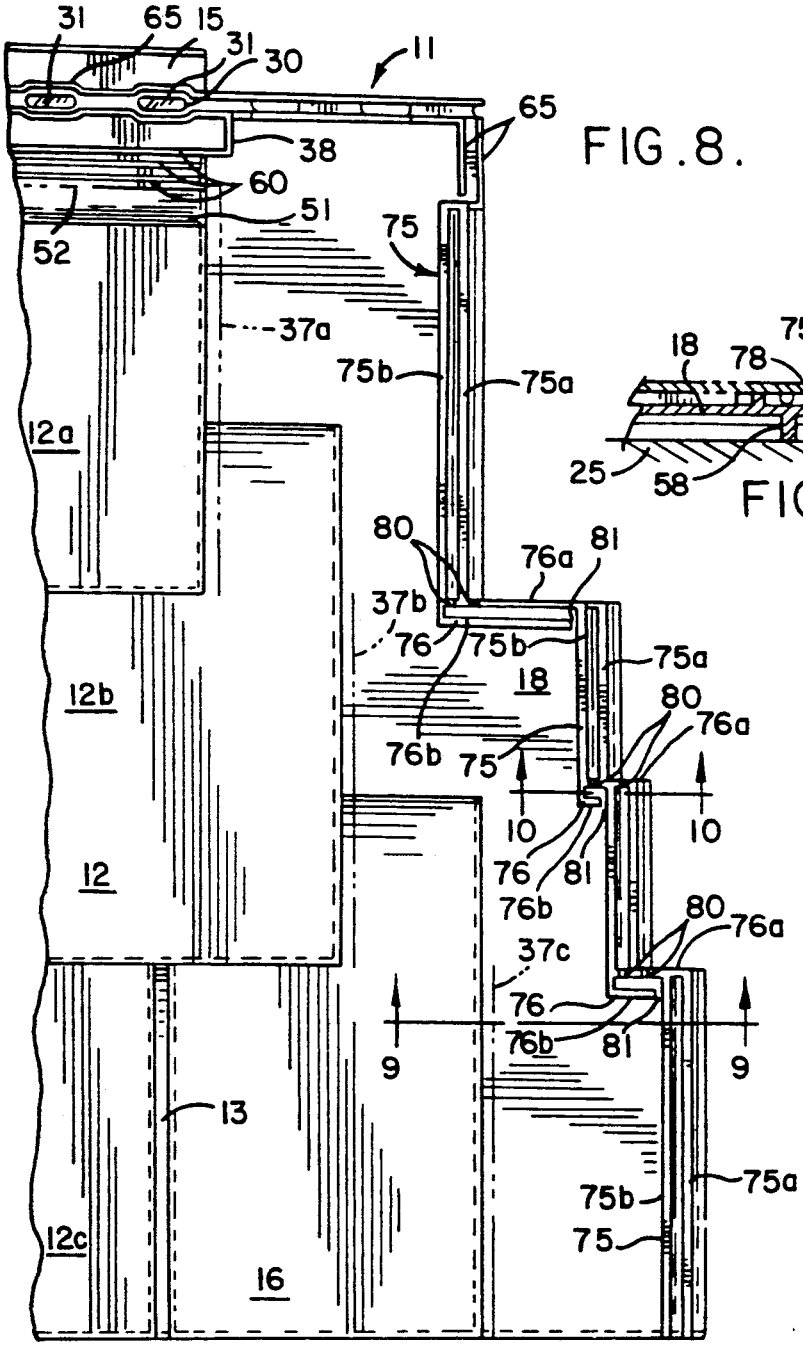
FIG. 8 is an enlarged face-side plan view of the right-hand portion of one of the illustrated panels.

It will be appreciated by one skilled in the art that the upper marginal edge region 15 has a width w that is relatively wide as compared to the exposed depth d of the shake 12, as best shown in FIGS. 3 and 8. The upper marginal edge region 15 preferably has a width w of at least ⅓ the depth d of the shake, and in the illustrated embodiment, the width w of the upper marginal edge region 15 is about ½ the exposed depth d of the shake. Such a relatively wide upper marginal edge region 15 provides ample space for the locating and sealing ledge 51, the sealing lip 55, the water barrier ridges 60, and nail aperture guard ridges 65, as well as increasing the distance upwardly migrating moisture must travel to reach the upper peripheral edge of the panel.

Hence, it can be seen that when the panels 11 of the present invention are mounted on the support surface 25, upward capillary movement of water between the overlapping upper and lower marginal edge regions is substantially impeded. Water must first overcome the primary seal 54 between the depending lip 50 and the face of the underlying panel, climb the locating ledge 51, overcome the plurality of barrier ridges 60, and then overcome the uninterrupted nail guard ridge 65 before reaching the nail apertures. Even then, the flashing 31 serves to provide a seal about the nails 32 for minimizing leakage of water through the nail holes. Before capillary movement of water reaches the upper periphery of the panel 11, it must overcome the second nail aperture guard ridge 65 on the top side of the nail hole, climb the upturned lip 55 at the upper peripheral edge of the panel, and migrate through the secondary seal 56 between the upturned lip 55 and the underside of the lower marginal edge region of the overlapping panel. Since the upper peripheral edge region 15 of the panel is fixed to the support surface by the nails 32 and the primary and secondary seals 54, 56 are securely maintained by the interlocking engagement between the upper peripheral edge of the marginal edge region 15 and the depending hooks 48 on the underside of the overlapping lower marginal edge region 16, leakage through the nail holes and seepage over the upper peripheral edge of the panel is effectively prevented, even during extremely adverse weather conditions.

Figure 2:
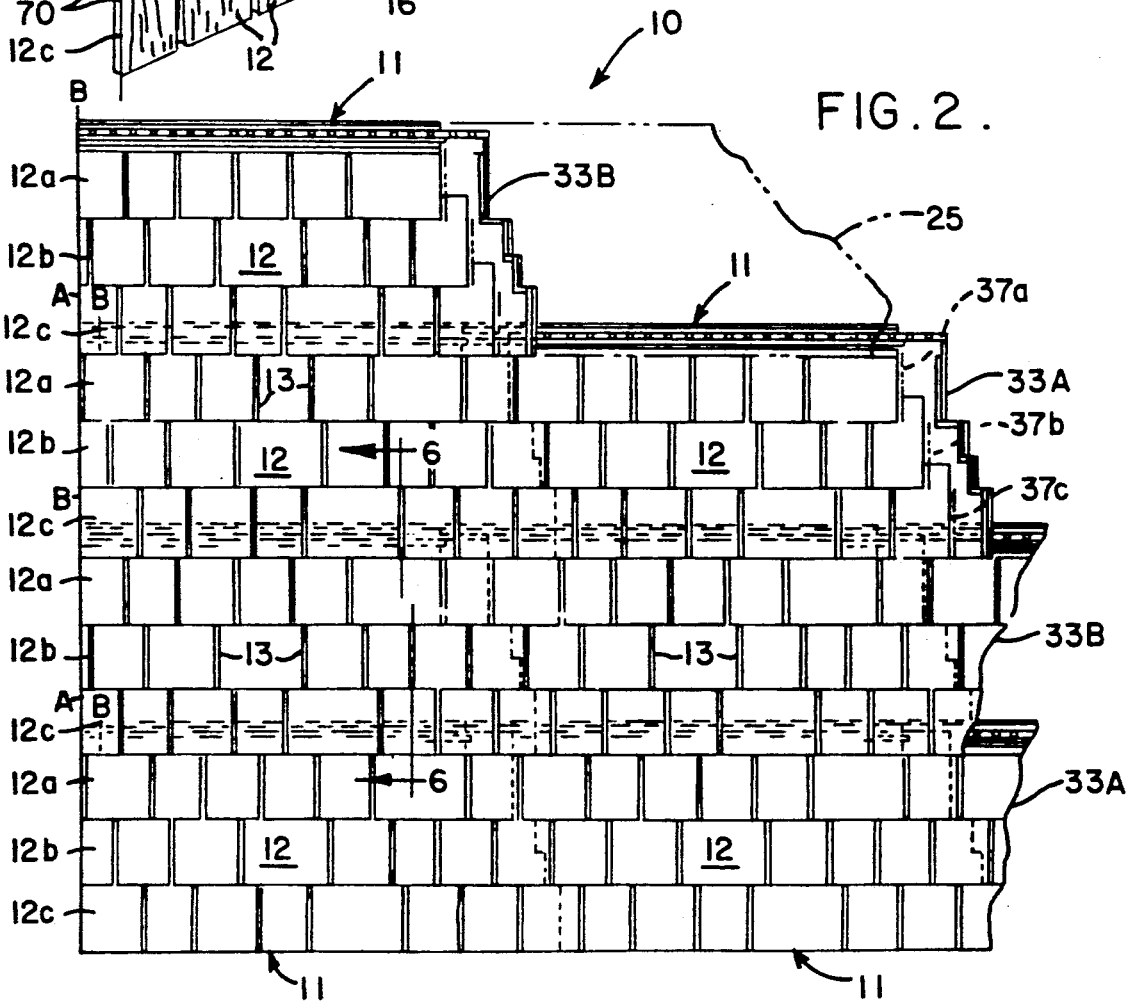
FIG. 2 is a plan view of several courses or rows of the panels which comprise the illustrated wall covering, shown in assembled relation to each other.
Figure 4:
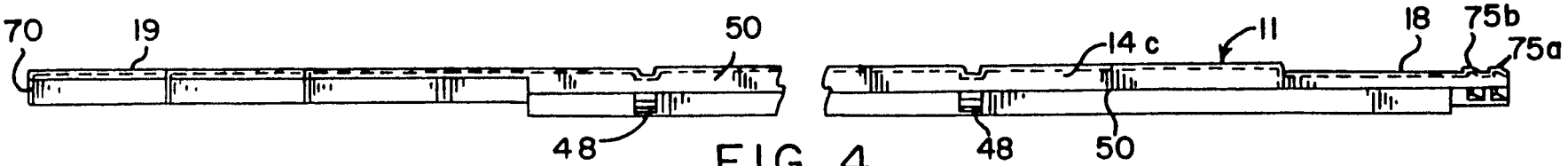
FIG. 4 is an enlarged bottom view of the panel shown in FIG. 3.

For forming a primary seal between the overlapping side marginal edge regions 18, 19 of adjacent panels 11, the stepped left-side peripheral edge of each panel is in the form of a stepped rearwardly directed sealing flange 70 adapted for positioning onto the face of the right-hand peripheral edge region 18 of the previously mounted panel with the sealing flange 70 in bearing engagement with the face of the marginal edge region 18 (FIGS. 1, 4 and 9). Such mounting of the panels positions the first shake 12 in each row 12*a*, 12*b*, 12*c* in closely spaced relation to the last shake o each row of the previously mounted panel. The spacing or gap 71 between the shake of adjacent panels 11 preferably should correspond substantially to that of the fixed gaps 40 between shake 12 formed in the panels (FIG. 9). Preferably the fixed gaps 40 between shake 12 are of various widths, such as in the range of between ¼ inch and 5/16 inch that the variance in the gap 71 between the last shake of each panel and the first shake of the adjacent panel caused by thermal expansion is substantially undetectable. To facilitate locating the left-hand peripheral edge of one panel 11 in properly overlapping relation onto the right-hand marginal edge region 18 of the previously mounted panel, the face of the right-hand marginal edge region 18 of each panel is formed with locating lines 72*a*, 72*b*, 72*c* immediately adjacent the last shake in each respective row 12*a*, 12*b*, 12*c* upon which the stepped, depending sealing flange 70 at the left-hand peripheral edge of the next mounted panel is positioned (FIGS. 2 and 8).

In keeping with the invention, side water barrier ridge means are provided between the overlapping side marginal edge regions 18, 19 of adjacent panels for impeding water migration between the overlapping side marginal edge regions. In the illustrated embodiment, the side water barrier ridge means include a plurality of vertical and horizontal water barrier ridges 75, 76, respectively, integrally formed on the face side of the right-hand marginal edge region 18 of each panel immediately adjacent the stepped peripheral edge of the panel 11, the vertical barrier ridges 75 being in parallel relation to the vertical sides of the stepped peripheral edge and the horizontal barrier ridges 76 being in parallel relation to the horizontal portions of the stepped peripheral edge. In the illustrated embodiment, pairs of vertical barrier ridges 75*a*, 75*b* are provided, with a first barrier ridge 75*a* of each pair being disposed immediately adjacent a respective vertical edge of the stepped section and a second vertical barrier ridge 75*b* being inwardly disposed in parallel relation to the first. Each vertical barrier ridge 75 has a vertical side 78 which forms a barrier for preventing liquid migration in a direction from the face side of the panel outwardly toward the peripheral edge thereof (FIGS. 9 and 10). The other side of each vertical ridge 75 is in the form of a tapered ramp 79 extending from the top of the ridge in a downwardly inclined direction for facilitating assembly of a second panel 11 onto the right-hand marginal edge region 18 of the previously mounted panel 11 by preventing the downwardly turned sealing lip 70 on the left-hand side of the panel from catching upon the barrier ridges 75. Instead, if the sealing lip 70 on the left-hand side of a panel 11 should be accidentally positioned on to the barrier ridges 75 during assembly, the ramps 79 permit easy sliding movement of the sealing lips 70 over the barrier ridges 75 to their properly mounted position on the locating lines 72*a*, 72*b*, 72*c*

The transverse barrier ridges 76 also are formed in pairs. Each pair includes a first transverse barrier ridge 76*a* adjacent a respective transverse peripheral edge portion of the upper marginal edge region 18 and a second barrier ridge 76*b* disposed in downwardly spaced relation to the first. The first transverse barrier ridge 76*a* extends inwardly to a location under the pair of vertical barrier ridges immediately thereabove. The second transverse barrier ridge 76*b* of each pair is connected to the lowermost end of a respective vertical barrier ridge 75*b* and extends to a position in closely spaced relation near the upper end of the inner barrier ridge 75*b* adjacent the next downwardly stepped section of the panel.

In carrying out the invention, the side barrier ridges 75, 76 are adapted not only for impeding capillary movement of the water outwardly along the right-side marginal edge region, but to facilate drainage of water that may enter the space between the overlapping side marginal edge regions 18, 19. As can be seen, the vertical water barrier ridges 75 and the transverse water barrier ridges 76 define stepped drainage passageways, while preventing direct upward and transverse water migration. To this end, drainage openings 80 are provided in the transverse barrier ridges 76*a* at locations adjacent the bottom of the vertical barrier ridges 75 for permitting the drainage of water which may migrate over one or both of the vertical barrier ridges 75*a*, 75*b* (FIG. 9). The openings 80 direct water onto the transverse barrier ridge 76*b* which preferably extends downwardly from a horizontal relatively small angle of between 10° and 15° to facilitate direction and drainage of water through drainage openings 81 defined between the end of the transverse barrier ridge 76*b* and the adjacent vertical barrier ridge 75*b*. The drainage openings 80, 81 all are disposed in horizontally offset relation to each other so as to prevent a direct vertical path for the capillary movement of water. Hence, the vertical and transverse barrier ridges 75, 76 defined between the overlapping side marginal edge regions 18, 19, like the barrier ridges 60 between the overlapping top and bottom marginal edge regions 15, 16, both impede the migration of water outwardly over the peripheral edge of the panel, while facilitating drainage of moisture in a downward direction.

From the foregoing, it will be seen that wall and roof coverings made of synthetic panels according to the present invention are adapted to form a substantially water resistant barrier over the support surface, even during relatively extreme adverse weather conditions. Water barrier means are provided between overlapping portions of the panels for impeding capillary movement of water while permitting free drainage of water that may enter the space between overlapping panel portions. While in the illustrated embodiment, the water barrier means have been formed on the face side of the upper and right-hand marginal edge regions, it will understood, that alternatively, the water barrier means could be provided on the underside of the lower and left-hand marginal edge regions. In either case, the panels of the present invention are of relatively simple construction so as to lend themselves to economical manufacture and easy failproof installation.

I claim:

1. A wall covering for mounting on a support surface disposed at an angle to the horizontal comprising a plurality of panels each having a relatively thin body portion formed with simulated building elements, said panels each have right-side and left-side marginal edge regions, said panels being mountable on said support surface in a plurality of vertically spaced horizontal courses with the left-side and right-side marginal edge regions of adjacent panels in overlapping relation, and said overlapping side marginal edge regions defining water barrier means in the form of a plurality of vertically oriented ridges disposed inwardly from the peripheral edges of the side marginal edge regions for impeding the movement of water laterally outwardly toward the peripheral edge of the underlying side marginal edge region.

2. A plastic one-piece wall covering panel for mounting on a support surface desposed at an angle to the horizontal comprising a relatively thin body formed with simulated building elements, said panel having an upper substantially horizontal marginal edge region, means defining a plurality of nail mounting apertures in said upper marginal edge region, said upper marginal edge region having at least one integrally formed substantially horizontal, discontinuous water barrier ridge between said simulated building elements and said nail mounting aperture defining means for impeding the upward movement of water along said upper marginal edge region from said building elements to said nail apertures and the upper peripheral edge of said panel while allowing drainage of water downwardly through said ridge.

3. A plastic one-piece wall covering panel for mounting on a support surface desposed at an angle to the horizontal comprising a relatively thin body formed with simulated building elements, said body having an upper substantially horizontal marginal edge region, means defining a plurality of nail mounting apertures in said upper marginal edge region, said panel having a side marginal edge region formed with a plurality of upstanding parallel water barrier ridges for impeding the movement of water from said simulated building elements outwardly to the peripheral edge of said side marginal edge region.

4. The wall covering panel of claim 3 in which said water barrier ridges are discontinuous so as to impede upward water movement while allowing drainage of water downwardly through said ridges.

5. The wall covering panel of claim 3 in which said body is formed with a plurality of horizontal rows of said building elements in the form of individual simulated shake shingles, said rows being laterally offset from each other so that the side marginal edge region has a staggered edges, and said side marginal edge region water barrier ridges include a plurality of vertical and transverse water barrier ridges adjacent the staggered edges of said side marginal edge region.

6. The wall covering panel of claim 5 in which said side marginal edge region is formed with locating lines adjacent each row of simulated shake for facilitating predetermined positioning of the left-side of a second panel onto said right-side marginal edge region in overlapping relation thereto.

7. The wall covering panel of claim 5 in which vertical and transverse side barrier ridges define water drainage passages.

8. A plastic one-piece wall covering panel for mounting on a support surface desposed at an angle to the horizontal comprising a relatively thin body formed with simulated building elements, said panel having an upper substantially horizontal marginal edge region, means defining a plurality of nail mounting apertures in said upper marginal edge region, said upper marginal edge region having a plurality of integrally formed substantially horizontal water barrier ridges between said simulated building elements and said nail mounting aperture defining means for impeding the upward movement of water along said upper marginal edge region from said building elements to the upper peripheral edge of said panel, and said upper marginal edge region further having a pair of uninterrupted nailing aperture guard ridges disposed on opposite sides of said nailing apertures between said water barrier ridges and the upper peripheral edge of said panel.

9. A wall covering for mounting on a support surface disposed at an angle to the horizontal comprising a plurality of panels each having a relatively thin body portion formed with simulated building elements, said panels each having upper and lower substantially horizontal marginal edge regions, said panels being mountable on said support surface in a plurality of vertically spaced horizontal courses with the lower marginal edge regions of the panels in one course overlapping the upper marginal edge regions of the panels in the course immediately therebelow, means defining primary and secondary seals between said overlapping marginal edge regions, said primary seal defining means including a downwardly turned lip formed along a bottom peripheral edge of each panel for bearing contact with a face of the underlying upper marginal edge region of a panel in the course below, said secondary seal defining means including an upturned lip along an upper peripheral edge of each panel for bearing contact with an underside of the overlapping bottom marginal edge region of the panel in the course immediately above, and said overlapping marginal edge regions defining water barrier means in the form of a plurality of parallel, substantially horizontally disposed ridges located between said primary and secondary seal defining means for impeding the upward movement of water between said overlapping marginal edge regions.

10. A wall covering for mounting on a support surface disposed at an angle to the horizontal comprising a plurality of panels each having a relatively thin body portion formed with simulated building elements, said panels each having upper and lower substantially horizontal marginal edge regions, said panels being mountable on said support surface in a plurality of vertically spaced horizontal courses with the lower marginal edge regions of the panels in one course overlapping the upper marginal edge regions of the panels in the course immediately therebelow, said overlapping marginal edge regions defining water barrier means in the form of a plurality of parallel, substantially horizontally disposed ridges for impeding the upward movement of water between said overlapping marginal edge regions, said upper marginal edge region of each panel being formed with a plurality of laterally spaced nailing apertures to facilitate nailing of said panel to said support surface, and said upper marginal edge region having a pair of horizontal nail guard aperture barrier ridges extending substantially the length of said panel on opposite sides of said nailing apertures.

11. The wall covering of claim 10 in which said nailing apertures are covered with a thin gauge plastic flashing which may be pierced by a nail during mounting of said panel on said support surface and which maintains a relatively tight seal about the nail.

12. A wall covering for mounting on a support surface disposed at an angle to the horizontal comprising a plurality of panels each having a relatively thin body portion formed with simulated building elements, said panels each having upper and lower substantially horizontal marginal edge regions, said panels being mountable on said support surface in a plurality of vertically spaced horizontal courses with the lower marginal edge regions of the panels in one course overlapping the upper marginal edge regions of the panels in the course immediately therebelow, said upper marginal edge region of each panel being formed with plurality of laterally spaced nailing aperture defining means to facilitate nailing of said panel to said support surface, said upper marginal edge region of each panel further being formed with a locating ledge over which the lower marginal edge region of the overlapping panel is positioned, and said overlapping marginal edge regions defining water barrier means in the form of a plurality of parallel, substantially horizontally disposed ridges for impeding the upward movement of water between said overlapping marginal edge regions, said water barrier ridges being integrally formed on said upper marginal edge region between said locating and sealing ledge and said nailing apertures.

13. The wall covering of claim 12 in which the lower marginal edge region of each panel has a downwardly turned lip for positioning over and engaging the locating ledge on the upper marginal edge region of the panel immediately therebelow.

14. The wall covering of claim 13 in which said locating ledges each are is formed with an inclined ramp on a side opposite that engaged by said downwardly turned lip of the overlying lower marginal edge region.

15. A wall covering for mounting on a support surface disposed at an angle to the horizontal comprising a plurality of panels each having a relatively thin body portion formed with simulated building elements, said panels each having upper and lower substantially horizontal marginal edge regions, said panels being mountable on said support surface in a plurality of vertically spaced horizontal courses with the lower marginal edge regions of the panels in one course overlapping the upper marginal edge regions of the panels in the course immediately therebelow, said upper marginal edge regions of said panels each being formed with locating lugs and notches that are engageable upon mounting of the panels on said support surface for horizontally aligning adjacent panels, and said overlapping marginal edge regions defining water barrier means in the form of a plurality of parallel, substantially horizontally disposed ridges for impeding the upward movement of water between said overlapping marginal edge regions.

16. A wall covering for mounting on a support surface disposed at an angle to the horizontal comprising a plurality of panels each having a relatively thin body portion formed with simulated building elements, said panels each having upper and lower substantially horizontal marginal edge regions and said right-side and left-side marginal edge regions, said panels being mountable on said support surface in a plurality of vertically spaced horizontal courses with the lower marginal edge regions of the panels in one course overlapping the upper marginal edge regions of the panels in the course immediately therebelow and with the left-side and right-side marginal edge regions of adjacent panels in overlapping relation, said overlapping upper and lower marginal edge regions defining water barrier means in the form of a plurality of parallel, substantially horizontally disposed ridges for impeding the upward movement of water between said overlapping marginal edge regions, and said overlapping side marginal edge regions defining water barrier means in the form of a plurality of ridges for impeding the outward movement of water toward the peripheral edge of the underlying side marginal edge region.

17. The wall covering of claim 16 in which each panel is formed with a plurality of horizontal rows of simulated shake shingles, said rows being laterally offset from each other so that said side marginal edge regions of each panel have staggered peripheral edges, said barrier ridges including a plurality of vertical barrier ridges adjacent vertical peripheral edges of said staggered marginal edge region and a plurality of transverse barrier ridges adjacent transverse peripheral edges of said staggered marginal edge region.

18. The wall covering of claim 17 in which said side barrier ridges are integrally formed on a face side of said side marginal edge regions, and said vertical and transverse side barrier ridges define water drainage passageways.

19. The wall covering of claim 18 in which at least some of said transverse barrier ridges define drainage openings.

20. The wall covering of claim 19 in which at least some of said transverse barrier ridges extend beneath said vertical barrier ridges and are formed with water drainage openings, and at least some of said transverse water barrier ridges extend into closely adjacent relation to a side of said vertical barrier ridges and define water drainage openings therebetween.

21. The wall covering of claim 20 in which said vertical water barrier ridges each have a vertical side for blocking movement of water and an opposite side that defines a tapered ramp.

22. The wall covering of claim 21 in which at least some of said transverse barrier ridges are inclined with respect to the horizontal to facilitate direction of draining water.

23. A wall covering for mounting on a support surface disposed at an angle to the horizontal comprising a plurality of panels each having a relatively thin body portion formed with simulated building elements, said panels each having upper and lower substantially horizontal marginal edge regions and right-side and left-side marginal edge regions, said panels being mountable on said support surface in a plurality of vertically spaced horizontal courses with the lower marginal edge regions of the panels in one course overlapping the upper marginal edge regions of the panels in the course immediately therebelow and with the left-side marginal edge region of each panel overlapping the right-side marginal edge region of the adjacent panel, said overlapping marginal edge regions defining water barrier means in the form of a plurality of parallel, substantially horizontally disposed ridges for impeding the upward movement of water between said overlapping marginal edge regions, and said overlapping side marginal edge regions defining water barrier means in the form of a plurality of ridges for impeding the outward movement of water toward the peripheral edge of the right-side marginal edge region.

24. The wall covering of claim 23 in which said right-side marginal edge regions are formed with locating lines for facilitating predetermined positioning of the left-side marginal edge region of the one panel in properly overlapping relation onto the underlying right-side marginal edge region.

25. A wall covering for mounting on a support surface disposed at an angle to the horizontal comprising a plurality of panels each having a relatively thin body portion formed with a plurality of horizontal rows of simulated shake shingles, said panels each having right-side and left-side marginal edge regions, said rows being laterally offset from each other so that said side marginal edge regions of each panel have staggered peripheral edges, said panels being mountable on said support surface in a plurality of vertically spaced horizontal courses with the left-side and right-side marginal edge regions of adjacent panels in overlapping relation, and said overlapping side marginal edge regions defining water barrier means in the form of a plurality of ridges for impeding the outward movement of water toward the peripheral edge of the underlying side marginal edge region, said barrier ridges including a plurality of vertical barrier ridges adjacent vertical peripheral edges of said staggered marginal edge region and a plurality of transverse barrier ridges adjacent transverse peripheral edges of said staggered marginal edge region.

26. The wall covering of claim 25 in which said side barrier ridges are integrally formed on a face side of said side marginal edge regions, and said vertical and transverse side barrier ridges define water drainage passageways.

27. The wall covering of claim 26 in which at least some of said transverse barrier ridges define drainage openings.

28. The wall covering of claim 27 in which at least some of said transverse barrier ridges extend beneath said vertical barrier ridges and are formed with water drainage openings, and at least some of said transverse water barrier ridges extend into closely adjacent relation to a side of said vertical barrier ridges and define water drainage openings therebetween.

29. A wall covering for mounting on a support surface disposed at an angle to the horizontal comprising a plurality of panels each having a relatively thin body portion formed with simulated building elements, said panels each have right-side and left-side marginal edge regions, said panels being mountable on said support surface in a plurality of vertically spaced horizontal courses with the left-side and right-side marginal edge regions of adjacent panels in overlapping relation, said right-side marginal edge regions being formed with locating lines for facilitating predetermined positioning of the left-side marginal edge region of the one panel in properly overlapping relation on the underlying right-side marginal edge region, and said overlapping side marginal edge regions defining water barrier means in the form of a plurality of ridges for impeding the outward movement of water toward the peripheral edge of the underlying side marginal edge region.

30. A plastic one-piece wall covering panel for mounting on a support surface desposed at an angle to the horizontal comprising a relatively thin body formed with simulated building elements, said panel having an upper substantially horizontal marginal edge region, means defining a plurality of nail mounting apertures in said upper marginal edge regions, said upper marginal edge region having a plurality of integrally formed substantially horizontal, discontinuous water barrier ridges between said simulated building elements and said nail mounting aperture defining means for impeding the upward movement of water along said upper marginal edge region from said building elements to the upper peripheral edge of said panel while allowing drainage of water downwardly through said ridges.

31. The wall covering panel of claim 30 in which said water barrier ridges each are formed with relatively small water flow openings at laterally spaced intervals with the water flow openings of one ridge being offset laterally from the water flow openings of an adjacent parallel ridge so as to prevent the straight passage of liquid upwardly through said ridges.

32. The wall covering panel of claim 30 in which said upper marginal edge region is formed with a locating and sealing ledge between said building elements and said water barrier ridges.

33. A plastic one-piece wall covering panel for mounting on a support surface desposed at an angle to the horizontal comprising a relatively thin body formed with simulated building elements, said panel having an upper substantially horizontal marginal edge region, means defining a plurality of nail mounting apertures in said upper marginal edge region, said panel having an upper peripheral edge in the form of an upturned sealing lip and a lower peripheral edge in the form of a downturned sealing lip, said upper marginal edge region having a plurality of integrally formed substantially horizontal water barrier ridges between said simulated building elements and said nail mounting aperture defining means for impeding the upward movement of water along said upper marginal edge region from said building elements to the upper peripheral edge of said panel.

34. A plastic one-piece wall covering panel for mounting on a support surface desposed at an angle to the horizontal comprising a relatively thin body formed with simulated building elements, said panel having an upper substantially horizontal marginal edge region and a side marginal edge region, means defining a plurality of nail mounting apertures in said upper marginal edge region, and upper marginal edge region having a plurality of integrally formed substantially horizontal water barrier ridges between said simulated building elements and said nail mounting aperture defining means for impeding the upward movement of water along said upper marginal edge region from said building elements to the upper peripheral edge of said panel, and said side marginal edge region having integrally formed parallel water barrier ridges for impeding the movement of water from said simulated bauilding elements outwardly to the peripheral edge of said side marginal edge region.

35. The wall covering panel of claim 34 in which said body is formed with a plurality of horizontal rows of individual simulated shake shingles, said rows being laterally offset from each other so that the side marginal edge region has a staggered edges, and said side marginal edge region water barrier ridges include a plurality of vertical and transverse water barrier ridges adjacent the staggered edges of said side marginal edge region.

36. The wall covering panel of claim 35 in which said right-side marginal edge region is formed with locating line adjacent each row of simulated shake for facilitating predetermined positioning of the left-side of a second panel onto said right-side marginal edge region in overlapping relation thereto.

37. The wall covering panel of claim 35 in which vertical and transverse side barrier ridges define water drainage passages.

38. A wall covering for mounting on a support surface disposed at an angle to the horizontal comprising a plurality of panels each having a relatively thin body portion formed with simulated building elements, said panels each having upper and lower substantially horizontal marginal edge regions, said panels being mountable on said support surface in a plurality of vertically spaced horizontal courses with the lower marginal edge regions of the panels in one course overlapping the upper marginal edge regions of the panels in the course immediately therebelow, and said overlapping marginal edge regions defining water barrier means in the form of a plurality of parallel, substantially horizontally disposed discontinuous ridges for impeding the upward movement of water between said overlapping marginal edge regions while allowing drainage of water downwardly through said ridges.

39. The wall covering of claim 38 in which said water barrier ridges each are formed with relatively small water flow openings at laterally spaced intervals with the water flow openings of one ridge being offset laterally from the water flow openings of an adjacent parallel ridge so as to prevent the straight passage of liquid upwardly through said ridges.

40. The wall covering of claim 38 in which said water barrier ridges are formed on a face of the upper marginal edge region of each panel.

41. The wall covering of claim 40 in which said upper marginal edge region is formed with three parallel water barrier ridges.

42. The wall covering of claim 40 in which said barrier ridges extend outwardly from the face of said upper marginal edge region a distance of between about 1/16 and ⅛ inch.

43. The wall covering of claim 38 including means defining primary and secondary seals between said overlapping marginal edge regions, and said water barrier ridges being disposed between said primary and secondary seal defining means.

44. The wall covering of claim 43 including means for positively interlocking said overlapping top and bottom marginal edge regions.

45. The wall covering of claim 44 in which said interlocking means includes a downwardly directed hook formed on the underside of each panel for receiving and retaining an upper peripheral edge of the panel in the course immediately below.

46. The wall covering of claim 45 in which said building elements are simulated shake shingles, and said panels are formed with a gap between said sides of adjacent simulated shake shingles and rigidifying and support ridges extending rearwardly of the panels for mounting the panel on the support surface.

47. The wall covering of claim 46 in which said panels each are formed with a plurality of downwardly directed hooks on the underside thereof, said hooks each being located at the bottom of one of said rigidifying and support ridges.

* * * * *